US007722402B2

(12) United States Patent
Pepe et al.

(10) Patent No.: US 7,722,402 B2
(45) Date of Patent: May 25, 2010

(54) PANEL INTERFACE MODULE WHICH PROVIDES ELECTRICAL CONNECTIVITY BETWEEN PANEL AND SHIELDED JACKS

(75) Inventors: Paul John Pepe, Clemmons, NC (US); Brian K. Davis, Winston-Salem, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/881,132

(22) Filed: Jul. 25, 2007

(65) Prior Publication Data

US 2008/0090461 A1 Apr. 17, 2008

Related U.S. Application Data

(60) Provisional application No. 60/852,207, filed on Oct. 16, 2006.

(51) Int. Cl.
*H01R 13/648* (2006.01)

(52) U.S. Cl. ..... 439/607.3; 439/939; 439/607.18; 439/607.23

(58) Field of Classification Search ..... 439/108, 439/609, 676, 701, 709, 540.1, 939, 607.18, 439/607.23, 607.27, 607.28, 607.3
See application file for complete search history.

(56) References Cited

U.S. PATENT DOCUMENTS 3,366,918 A * 1/1968 Johnson et al. ..... 439/607.28
5,639,261 A * 6/1997 Rutkowski et al. ..... 439/534
5,647,765 A * 7/1997 Haas et al. ..... 439/609
5,735,712 A 4/1998 Haas et al.
6,066,001 A 5/2000 Liptak et al.
6,227,911 B1 * 5/2001 Boutros et al. ..... 439/620.18
6,269,008 B1 7/2001 Hsu
7,033,210 B1 * 4/2006 Laurer et al. ..... 439/541.5
7,357,675 B2 * 4/2008 Barringer et al. ..... 439/609
2004/0229501 A1 * 11/2004 Caveney et al. ..... 439/540.1
2004/0246693 A1 12/2004 Lloyd et al.
2005/0136747 A1 * 6/2005 Caveney et al. ..... 439/676
2005/0164548 A1 * 7/2005 Spears et al. ..... 439/540.1
2005/0282432 A1 12/2005 Murr et al.

OTHER PUBLICATIONS

International Search Report, PCT/US2007/021571; dated Oct. 9, 2007.
IBM Technical Disclosure Bulletin, "Contact Spring for Radio Frequency Interference Reduction", Dec. 1993; p. 275; vol. 36; No. 12; Armonk, NY.

* cited by examiner

*Primary Examiner*—Edwin A. Leon
*Assistant Examiner*—Vanessa Girardi

(57) ABSTRACT

An interface module includes a housing having a plurality of jack openings configured to receive shielded modular jacks therein. The housing has a mounting wall extending along one side of the jack openings. A bond bar is coupled to the mounting wall, wherein the bond bar has a jack interface configured to engage respective ones of the shielded modular jacks and a panel interface configured to engage a mating surface of a panel. The bond bar is configured to create an electrical connection between respective ones of the shielded modular jacks and the mating surface of the panel.

20 Claims, 8 Drawing Sheets

PANEL INTERFACE MODULE WHICH PROVIDES ELECTRICAL CONNECTIVITY BETWEEN PANEL AND SHIELDED JACKS

CROSS REFERENCE TO RELATED APPLICATIONS

This application claims the benefit of U.S. Provisional Application No. 60/852,207 titled INTERFACE MODULE and filed on Oct. 16, 2006, the subject matter of which is herein expressly incorporated by reference in its entirety.

BACKGROUND OF THE INVENTION

This invention relates generally to connector modules that interface network components and, more particularly, to an interface module for shielded connectors.

Electronic components are typically connected to an electronic network using patch panels that allow connections between components in the network. In some applications, an interface module may be retained in the patch panel, or any number of other network structures that interconnect two or more separate network components. The interface module provides for easier mounting of a plurality of modular jacks into a single opening in the patch panel or other network structure. In a typical application, the interface module is mounted to the patch panel and the modular jacks are then loaded into the interface module.

Existing interface modules allow a plurality of unshielded jacks to be loaded therein. However, to meet the current performance requirements, new jack designs may be shielded, for example, using a metal housing that may increase the size of the jack. Effective shielding requires that all components be shielded and all shields be sufficiently bonded. However, in addition to not accommodating the increased jack sizes, current interface modules do not enable shielded jacks to be bonded and/or grounded to the patch panel.

BRIEF DESCRIPTION OF THE INVENTION

In one embodiment, an interface module is provided including a housing having a plurality of jack openings configured to receive shielded modular jacks therein. The housing has a mounting wall extending along one side of the jack openings. A bond bar is coupled to the mounting wall, wherein the bond bar has a jack interface configured to engage respective ones of the shielded modular jacks and a panel interface configured to engage a mating surface of a panel. The bond bar is configured to create an electrical connection between respective ones of the shielded modular jacks and the mating surface of the panel.

Optionally, a single bond bar is provided that engages multiple ones of the shielded modular jacks. Alternatively, multiple bond bars may be coupled to the housing, wherein each bond bar is configured to engage at least one of the shielded modular jacks. The bond bar may include a plurality of flexible beams provided on the panel interface, wherein the flexible beams are configured to be loaded against the mating surface of the panel to maintain connection between the bond bar and the panel. Optionally, the jack interface and the panel interface may be spaced apart from one another and extend generally parallel to one another, and the bond bar may includes an end wall extending between the jack interface and the panel interface.

In another embodiment, an interface module is provided that includes a housing configured to be mounted to a panel, wherein the housing has a plurality of jack openings configured to receive shielded modular jacks therein. A bond surface is provided on the housing, wherein the bond surface has a jack interface configured to engage the shielded modular jacks and a panel interface configured to engage a mating surface of the panel. The bond surface is configured to electrically common the shielded modular jacks and the panel. A latch mechanism is provided on the housing, wherein the latch mechanism is configured to securely couple the housing to the panel.

In a further embodiment, an interface module is provided that includes a plurality of shielded modular jacks and a housing having a plurality of jack openings that receive respective ones of the shielded modular jacks. The housing is configured to be mounted to a panel such that the plurality of shielded modular jacks are simultaneously mounted to the panel. A bond bar is coupled to the housing, wherein the bond bar has a jack interface engaging respective ones of the shielded modular jacks and a panel interface configured to engage a mating surface of the panel. The bond bar is configured to create an electrical connection between the respective ones of the shielded modular jacks and the mating surface when the housing is mounted to the panel.

DETAILED DESCRIPTION OF THE INVENTION

Figure 1:
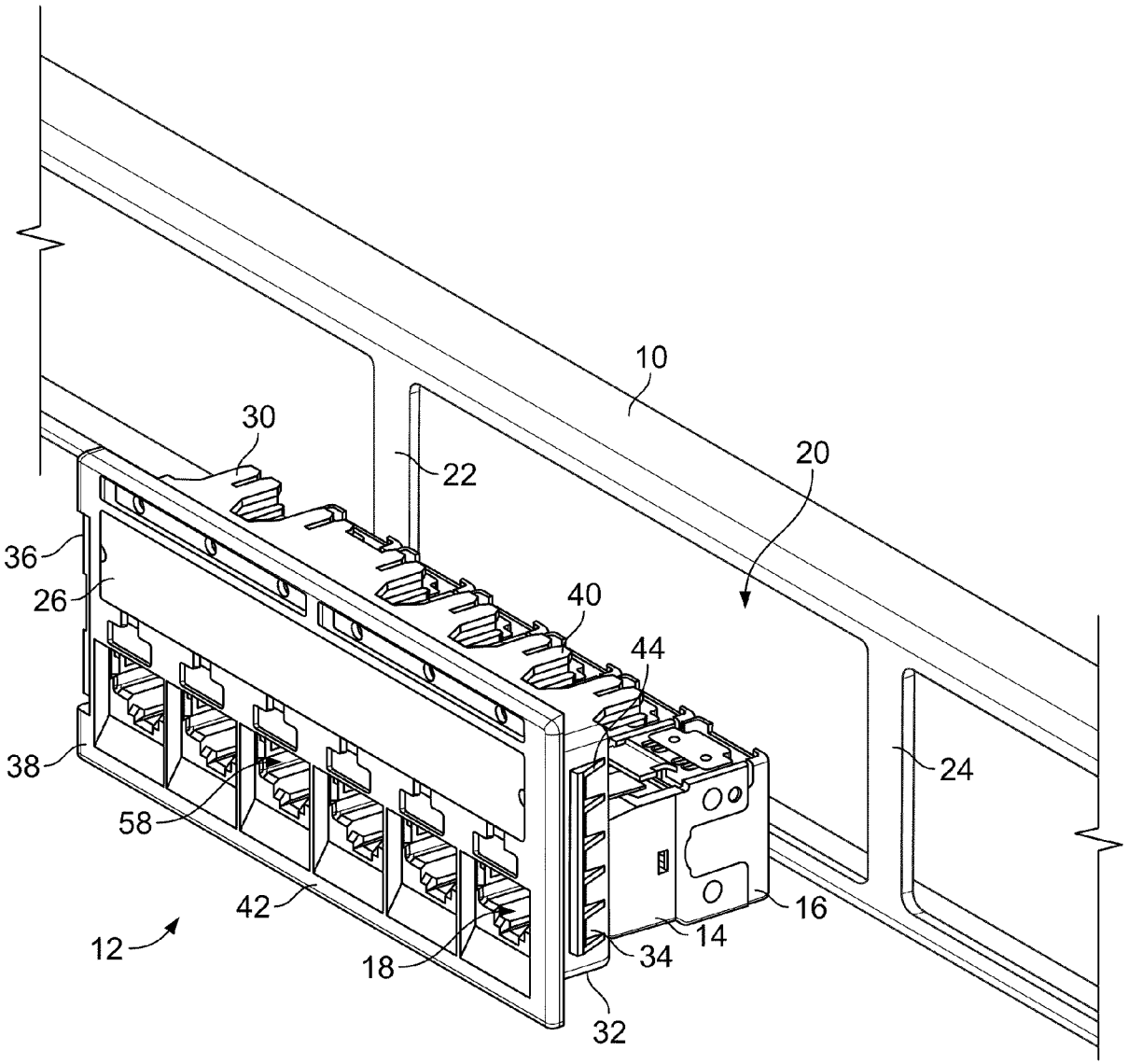
FIG. 1 shows a front perspective view of a panel and an exemplary embodiment of an interface module with shielded modular jacks loaded therein.
Figure 2:
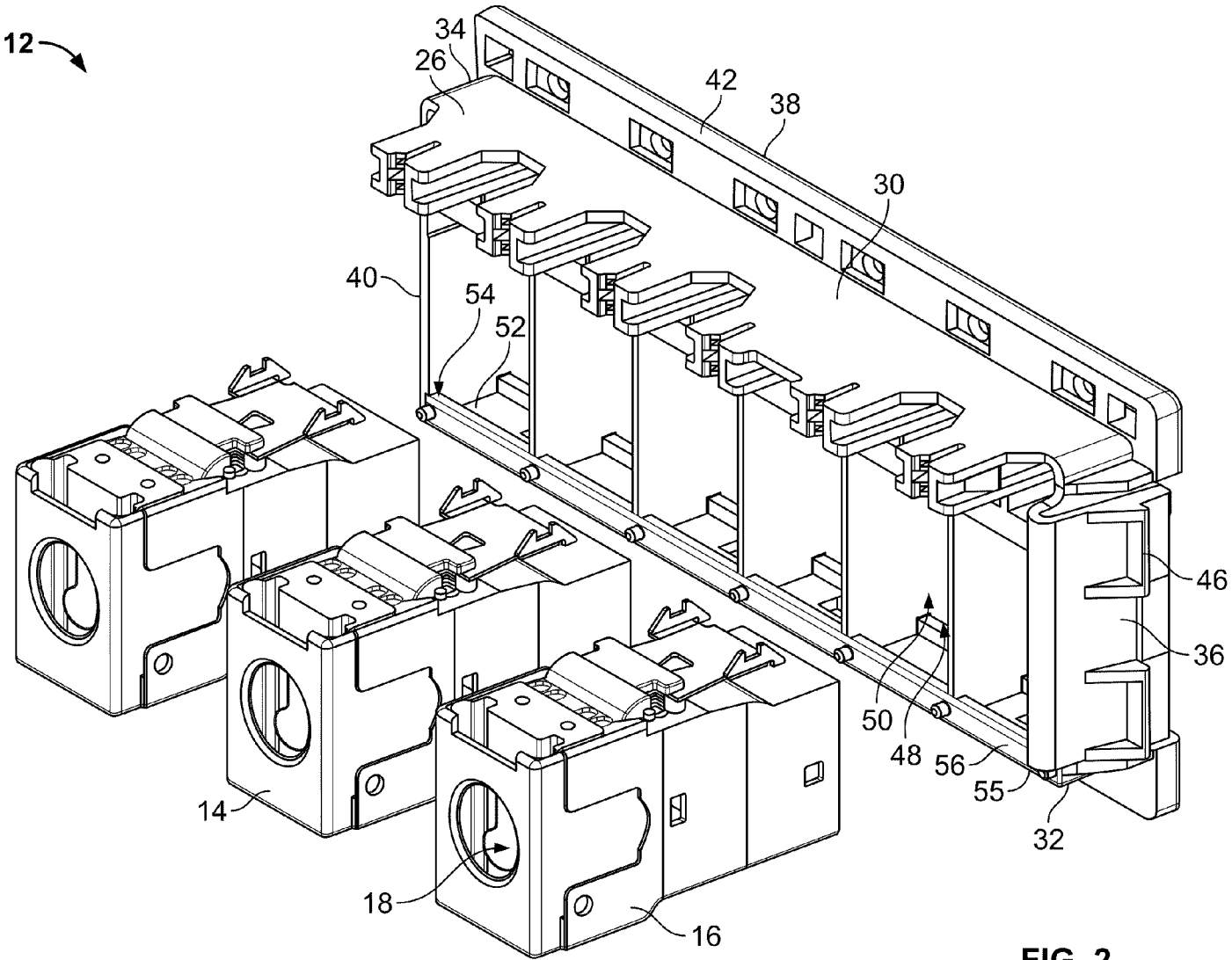
FIG. 2 is an exploded view of the interface module and shielded modular jacks of FIG. 1.

FIG. 1 shows a front perspective view of a panel 10 and an exemplary embodiment of an interface module 12 with shielded modular jacks 14 loaded therein. FIG. 2 is an exploded view of the interface module 12 and shielded modular jacks 14. As described herein, the interface module 12 is particularly adapted for use with shielded modular jacks 14. The interface module 12 simultaneously mounts a plurality of shielded modular jacks 14 to the panel 10. The interface module 12 defines a bond path or interface between the shielded modular jacks 14 and the panel 10. The bond path makes an electrical connection between the components. Optionally, when one of the components (e.g. the panel 10) is taken to ground (e.g. electrically grounded), then the bond path defines a ground path between the components.

As illustrated in FIG. 2, the shielded modular jacks 14 are metalized, such as by an injection process or by providing a shield component to the jack housing 18. As such, the shielded modular jacks 14 include shielded surfaces 16 surrounding jack housings 18. The shielded modular jack 14 may be any type of shielded cable connector, such as, but not limited to, the shielded modular RJ-45 jack illustrated in the Figures. The shielded surface 16 increases the size of the jack as compared to non-shielded jacks, which typically have an envelope similar to the jack housing 18. In an exemplary electronic network in which the shielded modular jacks 14 are utilized, the shielded surface 16 is bonded (e.g. electrically connected) to a grounded component, such as the panel 10, to provide a ground path to the shielded surface 16. When the interface module 12 is mounted to the panel 10, the interface module 12 provides a ground path to ground and bond the shielded modular jack 14 to the panel 10.

As illustrated in FIG. 1, the interface module 12 is mounted within an opening 20 of the panel 10. The opening 20 is defined by a perimeter wall 22. In an exemplary embodiment, the panel 10 includes a plurality of openings 20 for receiving a plurality of interface modules 12. Optionally, the openings 20 may receive interface modules 12 having either shielded modular jacks, as illustrated in FIG. 1, or non-shielded modular jacks. The panel 10 includes a planar front surface 24, and the interface module 12 is mounted against the front surface 24. In the illustrated embodiment, the panel 10 is a patch panel that may be mounted to a rack (not shown). In alternative embodiments, the panel 10 may be another type of network component used within a network system that supports modular jacks, such as a switch, a power box, and the like. As known in the art, the panel 10 is metallic and a means to ground and bond the panel is provided, such as a frame, rack, cable, wire, or other structure that is electrically connected to the panel 10.

In an exemplary embodiment, the interface module 12 includes a housing 26 that includes a dielectric body fabricated from a dielectric material, such as a plastic material. The housing 26 includes a bond surface for interconnecting the shielded modular jacks 14 and the panel 10. For example, in an exemplary embodiment, the housing 26 is selectively plated with a conductive material, such as a metal material, to create the bond surface. Thus, when the shielded modular jacks 14 are loaded into the housing 26, the conductive plating engages the shielded modular jack 14 to create a bond and ground therebetween. When the interface module 12 is mounted into the panel 10, the conductive plating engages the panel 10 to create a bond and ground path therebetween. Accordingly, when the shielded modular jacks 14 are assembled into the interface module 12, which is then mounted into the panel 10, a ground path is made for the shielded modular jacks 14. In an exemplary embodiment, the conductive plating may constitute a bond bar 28 (shown in FIGS. 3-5) that is coupled to the housing 26. The bond bar 28 is described in further detail below. It is realized that the bond bar 28 is merely one example of a conductive plating type of structural element that may be used to define a bond surface and to interconnect the shielded modular jacks 14 with the panel 10 to create a bond path, and potentially a ground path, therebetween. The bond bar 28, or its equivalent, may have many different shapes, sizes, and configurations to accomplish the interconnection of the shielded modular jacks 14 and the panel 10, depending on the configuration of the interface module 12.

In an alternative embodiment, rather than the conductive plating, the interface module 12 may be die cast or may be selectively metalized during a manufacturing process, such as an injection molding process, to create the bond surface. In such embodiments, the ground path is established by the shielded modular jacks 14 contacting the interface module 12 and the interface module 12 then contacting the panel 10.

As shown in FIGS. 1 and 2, the housing 26 generally includes a top 30, bottom 32, sides 34 and 36, a front 38 and a rear 40. A faceplate 42 is provided at the front 38. The faceplate 42 may be integrally formed with the housing 26, such as in the illustrated embodiment, or the faceplate may be separately provided from and coupled to the housing 26. The faceplate 42 is exposed when the interface module 12 is mounted to the panel 10 (shown in FIG. 1). A fixed latch 44 is provided along the first side 34 and a flexible latch 46 is provided along the second side 36. The fixed and flexible latches 44, 46 are used to mount the interface module 12 to the panel 10. For example, the interface module 12 is inserted into the panel opening 20 (shown in FIG. 1) so that fixed latch 44 engages the perimeter wall 22. The interface module 12 is then pivoted so that the flexible latch 46 engages and/or locks onto the perimeter wall 22 of the opening 20. Alternatively, mating latches or features may be provided on the panel 10 to interact with the fixed and/or flexible latches 44, 46.

The housing 26 also includes a plurality of jack openings 48 at the rear 40 that receive the shielded modular jacks 14 therein. The jack openings 48 are adapted to provide the proper opening dimensions for holding the shielded modular jacks 14 therein. The jack openings 48 provide access to jack cavities 50 that are sized and shaped to receive the shielded modular jacks 14. In the illustrated embodiment, the jack cavities 50 are generally box-shaped, but may be shaped differently if the shielded modular jacks 14 are shaped differently. A bottom wall 52 defines a portion of the jack openings 48. In an exemplary embodiment, the shielded modular jacks 14 are mounted to the bottom wall 52, which defines a mounting wall 52. The bottom wall 52 includes an inner, or first, wall surface 54 that faces and extends at least partially along the jack cavities 50. The bottom wall 52 also includes an outer, or second, wall surface 55, generally opposite to, and extending substantially parallel to, the inner surface 54, and an end surface 56 extending between the inner and outer surfaces 54, 55. In the illustrated embodiment, the surfaces 54, 55, 56 are generally flat, but the surfaces 54, 55, 56 may have a different, more complicated geometry in alternative embodiments.

As illustrated in FIG. 1, the faceplate 42 includes mating plug openings 58 at the front 38 that are aligned with, and provide access to, the jack cavities 50. The mating plug openings 58 are sized and shaped to receive mating plugs (not shown) that are connected to the shielded modular jacks 14. In the illustrated embodiment, the mating plug openings 58 define an RJ-45 envelope configured to receive an RJ-45 plug.

In an exemplary embodiment, the housing 26 is fabricated as a single piece, however, the various components of the housing 26 may be assembled together.

Figure 3:
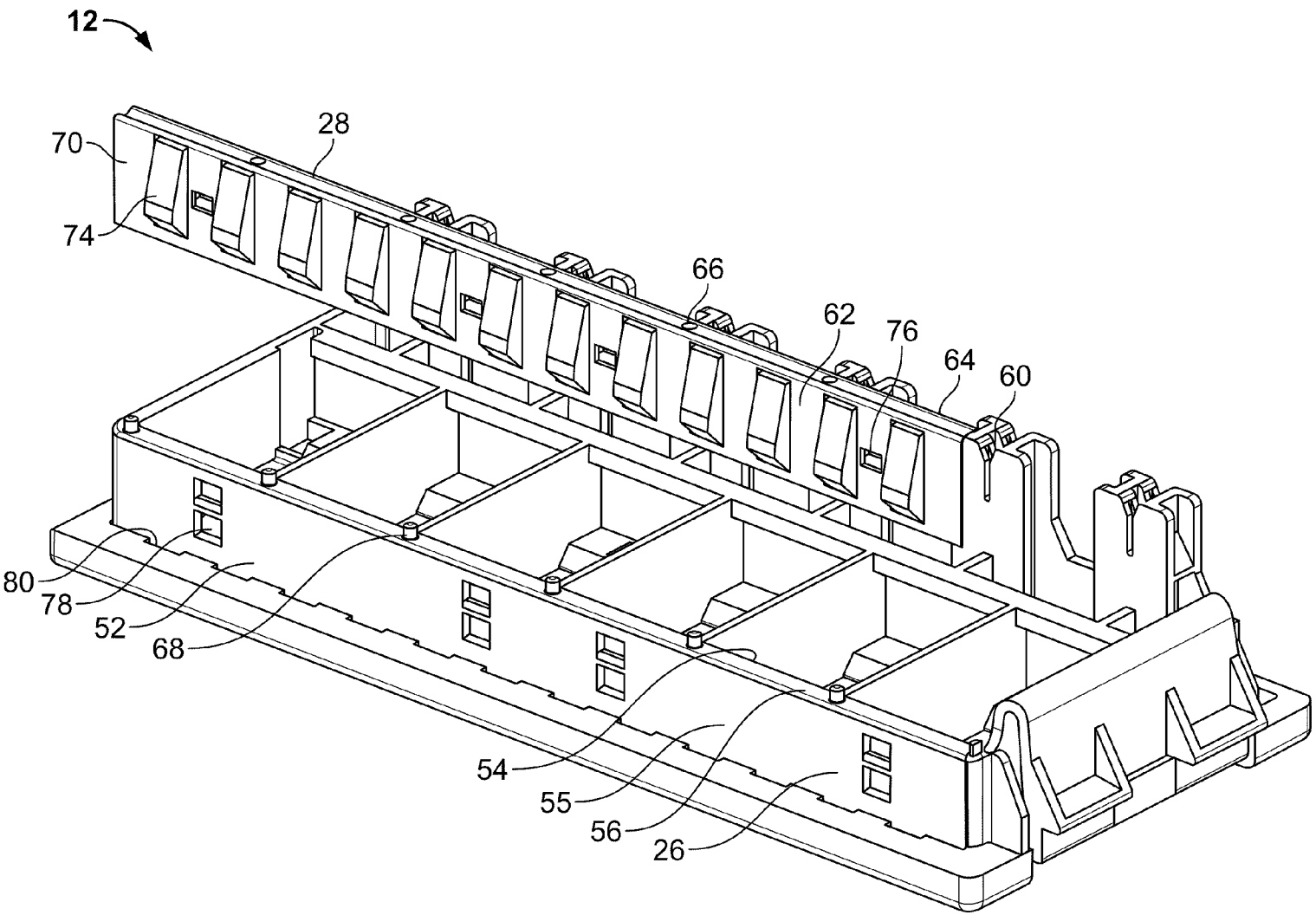
FIG. 3 is an exploded bottom rear perspective view of the interface module of FIG. 1.
Figure 4:
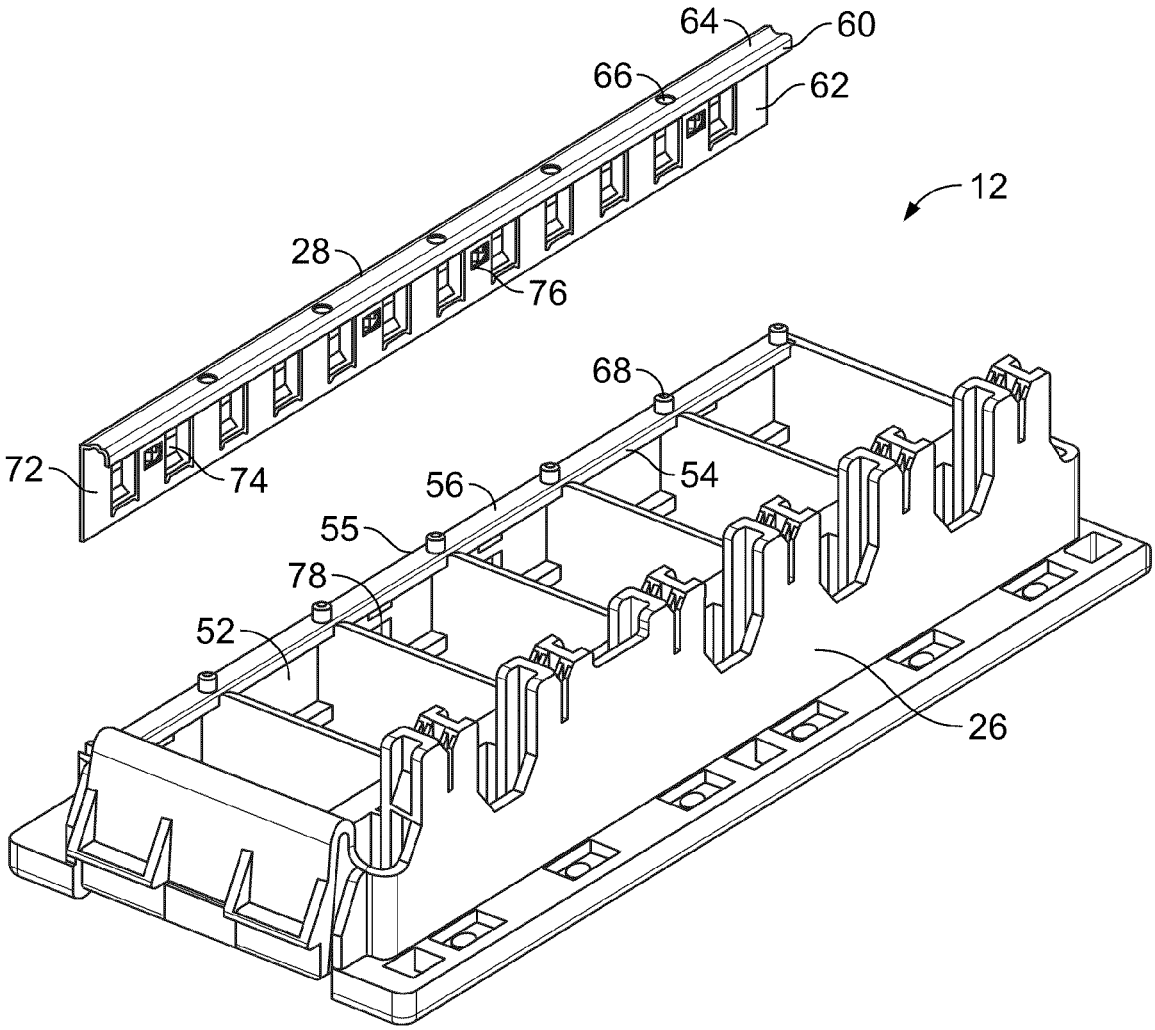
FIG. 4 is an exploded top rear perspective view of the interface module of FIG. 1.
Figure 5:
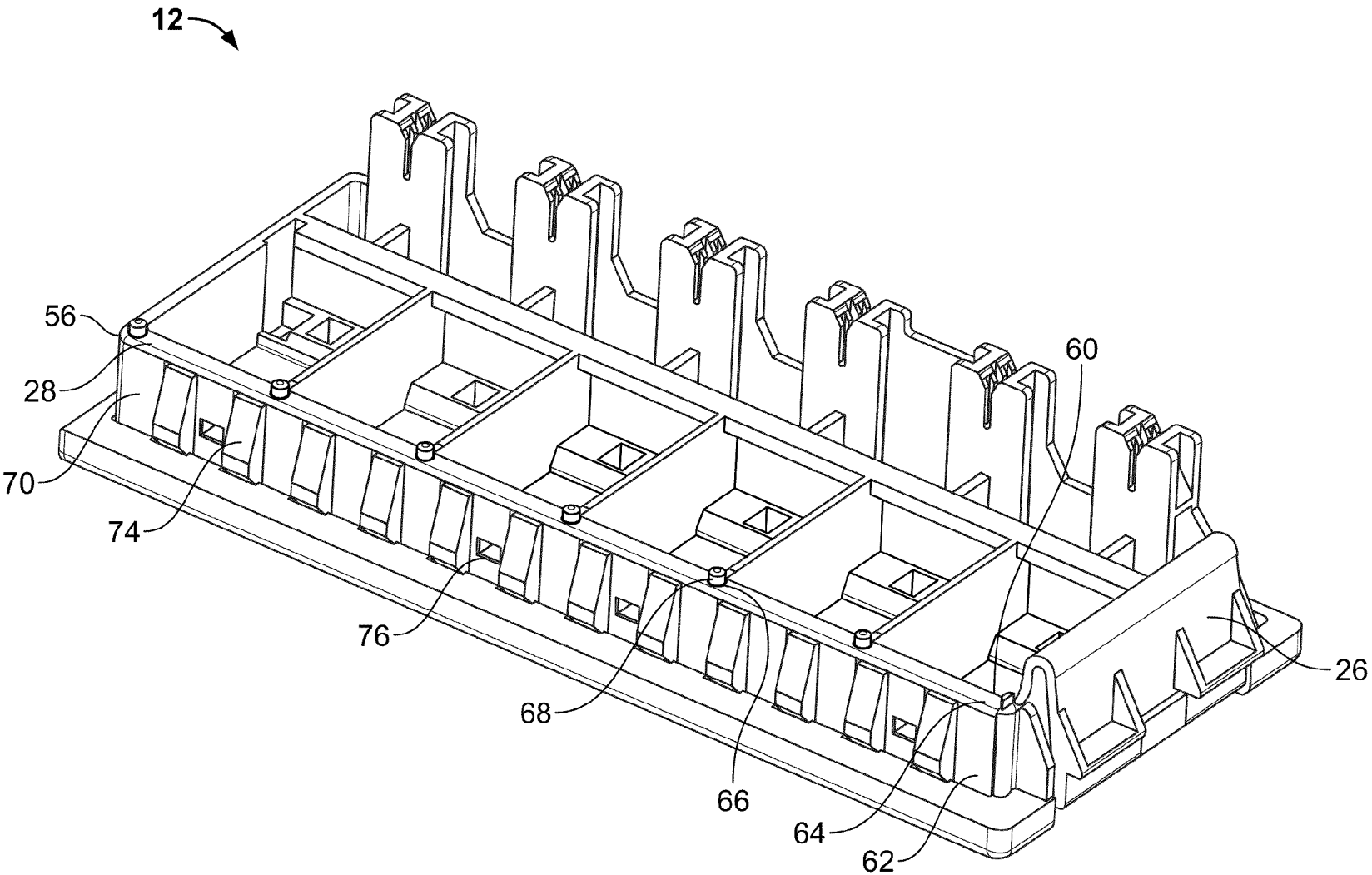
FIG. 5 is a bottom rear perspective view of the interface module of FIG. 1.

FIG. 3 is an exploded bottom rear perspective view of the housing 26 portion of the interface module 12 with the shielded modular jacks 14 removed and illustrating the bond bar 28 formed in accordance with an exemplary embodiment. FIG. 4 is an exploded top rear perspective view of the housing portion of the interface module 12 and the bond bar 28. FIG. 5 is a bottom rear perspective view of the housing portion of the interface module 12, illustrating the bond bar 28 coupled to the housing 26.

In an exemplary embodiment, the bond bar 28 is a metallic j-shaped bar having a first flat portion extending along the longitudinal length of the bond bar 28 that defines a jack interface 60, a second flat portion extending along the longitudinal length of the bond bar 28 that defines a panel interface 62, and an end wall 64 extending between the jack interface 60 and the panel interface 62 forming the j-shape. The bond bar 28 is attached to the housing 26 so that the jack interface 60 of the bond bar 28 significantly covers the inner surface 54 of the housing 26. When the bond bar 28 is attached to the housing 26, the panel interface 62 of the bond bar 28 significantly covers the outer surface 55. Similarly, when the bond bar 28 is attached to the housing 26, the end wall 64 of the bond bar 28 significantly covers the end surface 56. In the illustrated embodiment, one leg of the j-shaped bond bar 28, namely the panel interface 62, is wider then the other leg, however both legs may be substantially equal in width in alternative embodiments forming more of a c-shaped bond bar 28. Additionally, in other alternative embodiments, the bond bar 28 may have a more complex shape to substantially conform to the housing 26.

As illustrated in FIG. 5, the bond bar 28 is formed to fixedly attach to the housing 26. In one embodiment, holes and/or cutouts 66 are formed in the bond bar 28 and are aligned with posts 68 on the end surface 56 of the housing 26. The bond bar 28 is placed on the housing 26 so that the posts 68 are inserted through the holes and/or cutouts 66 as the bond bar 28 is attached to the housing 26. Once the bond bar 28 is in contact with the housing 26 along the length of the end surface 56, the posts 68 are flattened to secure the bond bar 28 to the end surface 56 of the housing 26. In alternative embodiments, other fastening means as known in the art may be used to secure the bond bar 28 to the housing 26. For example, the bond bar 28 may simply be snapped into place, fasteners may be used, latches may be used, the bond bar 28 may be frictionally coupled to the housing 26, the shielded modular jacks 14 may be used to retain the bond bar 28 in position, and the like.

As shown in FIGS. 3 and 4, in an exemplary embodiment, the panel interface 62 of the bond bar 28 includes an outer surface 70 (FIG. 3) and an inner surface 72 (FIG. 4). A plurality of flexible beams 74 are formed on, and extend from, the outer surface 70. As described in further detail below, the flexible beams 74 may define spring-like elements to provide a normal force against the panel 10 when the housing 26 is mounted to the panel 10. One or more protrusions 76 are located on, and extend from, the inner surface 72 of the panel interface 62. The bottom wall 52 of the housing 26 includes one or more cutouts 78 aligned with the protrusions 76. As the bond bar 28 is installed onto the housing 26, the protrusions 76 snap into the cutouts 78 to orient the bond bar 28 with respect to the housing 26. As known to those skilled in the art, other means of attaching the bond bar 28 to the housing 26 would be suitable.

As illustrated in FIG. 3, in an exemplary embodiment, the housing 26 includes a plurality of notches 80 in the faceplate 42. As illustrated in FIG. 5, the flexible beams 74 of the bond bar 28 are aligned with, and may be at least partially received within, the notches 80. As described in further detail below, when the housing 26 is mounted to the panel 10, the flexible beams 74 are compressed and biased against the panel 10 so that contact is made between the flexible beams 74 of the bond bar 28 and the panel 10. As the flexible beams 74 are compressed, the ends of the flexible beams 74 may move into the associated notches 80.

Figure 6:
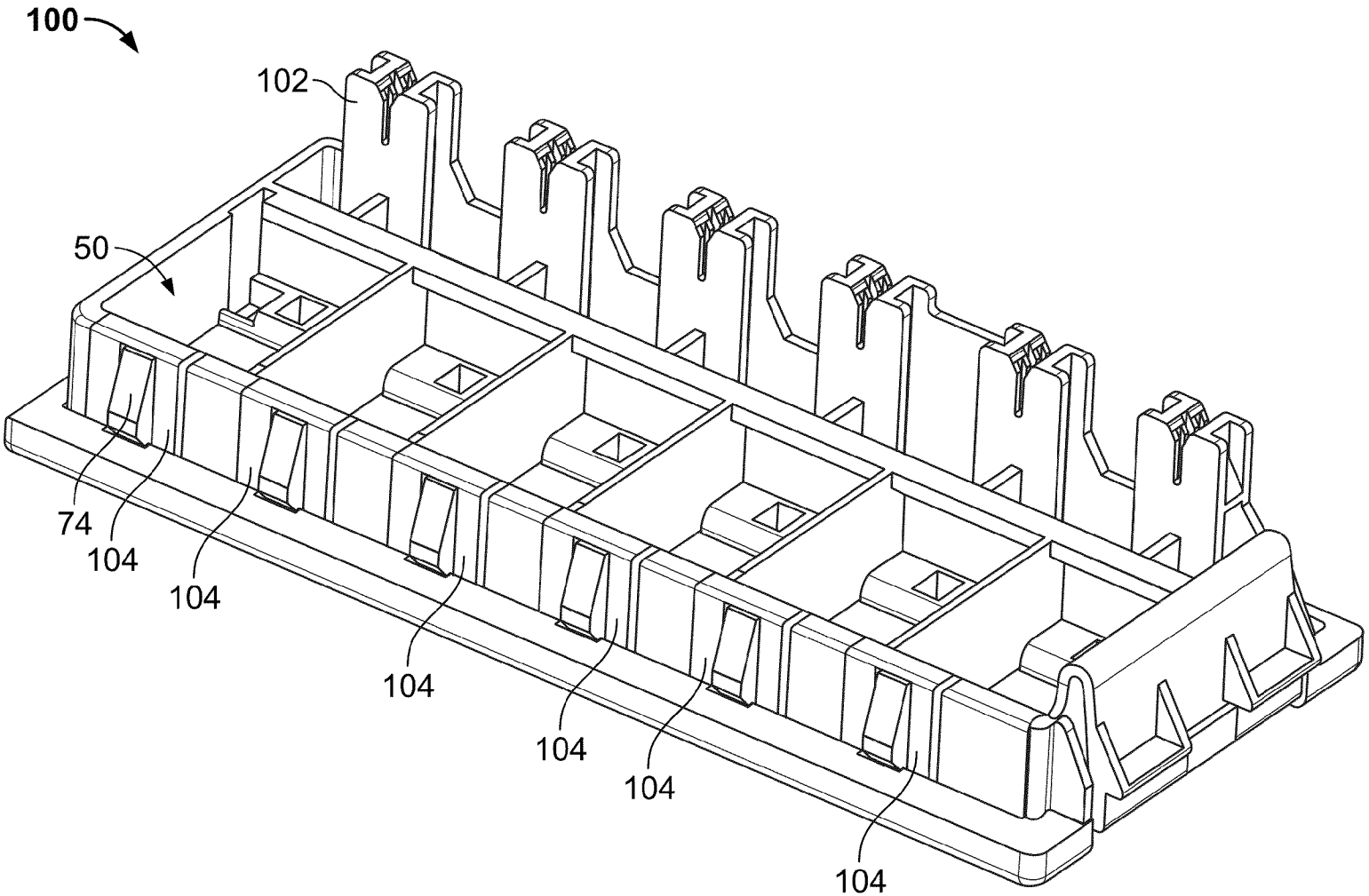
FIG. 6 is a bottom rear perspective view of an alternative interface module.

FIG. 6 is a bottom rear perspective view of an alternative interface module 100 with the shielded modular jacks 14 removed. The interface module 100 includes a housing 102 and a plurality of bond bars 104. The housing 102 is substantially similar to the housing 26, and like elements have like reference numerals. In the illustrated embodiment, individual bond bars 104 are provided for each jack opening 50. Each bond bar 104 is configured to engage a respective one of the shielded modular jacks 14 (shown in FIG. 1). The bond bars 104 are coupled to the housing 102, such as by a snap-fit coupling. Each bond bar 104 includes at least one flexible beam 74 for engaging the panel 10 (shown in FIG. 1) for creating a bond path, and potentially a ground path, between the panel 10 and the respective shielded modular jack 14.

Figure 7:
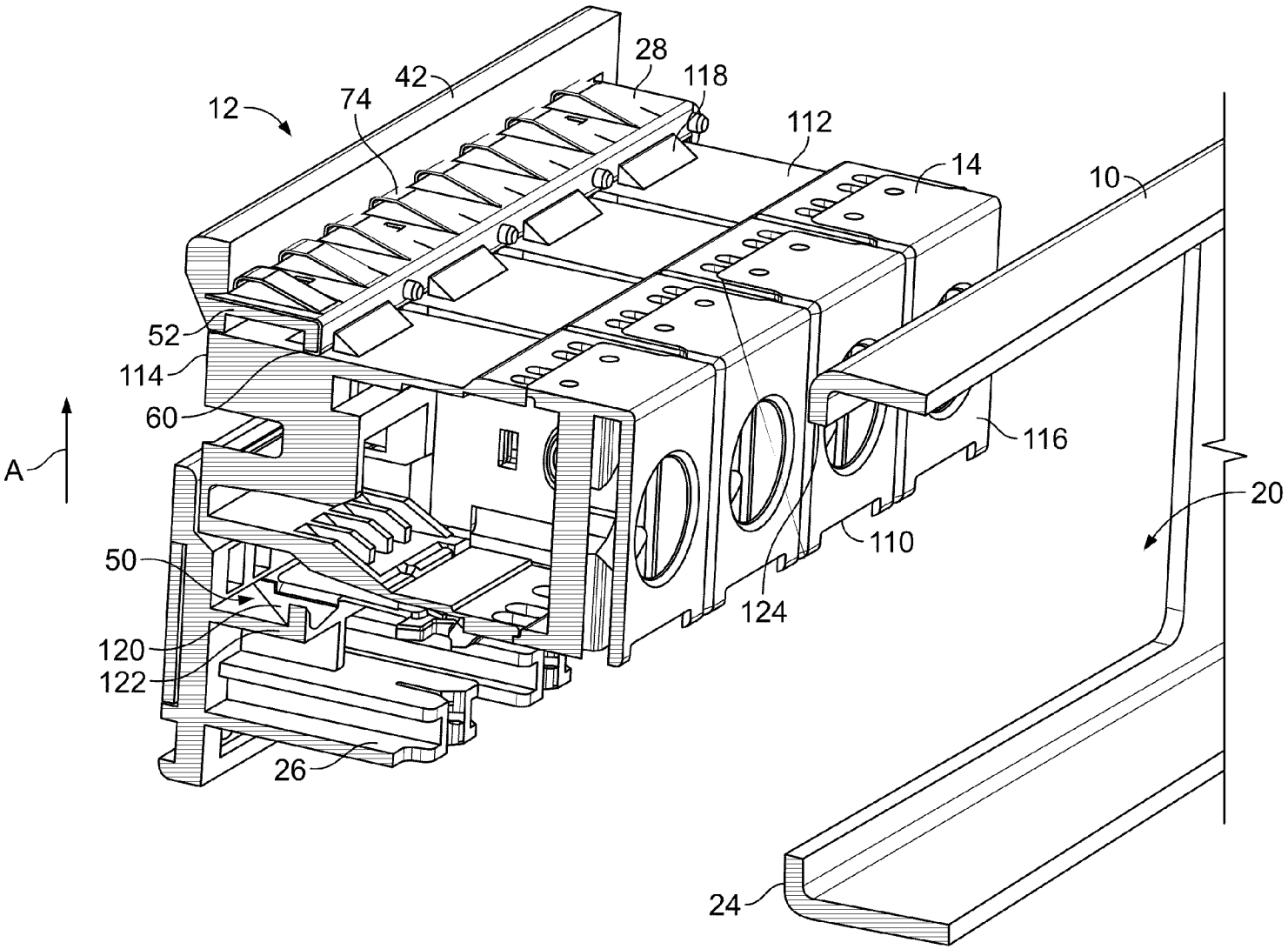
FIG. 7 shows a rear bottom cutaway view of the interface module of FIG. 1 with the shielded modular jacks loaded therein.
Figure 8A:
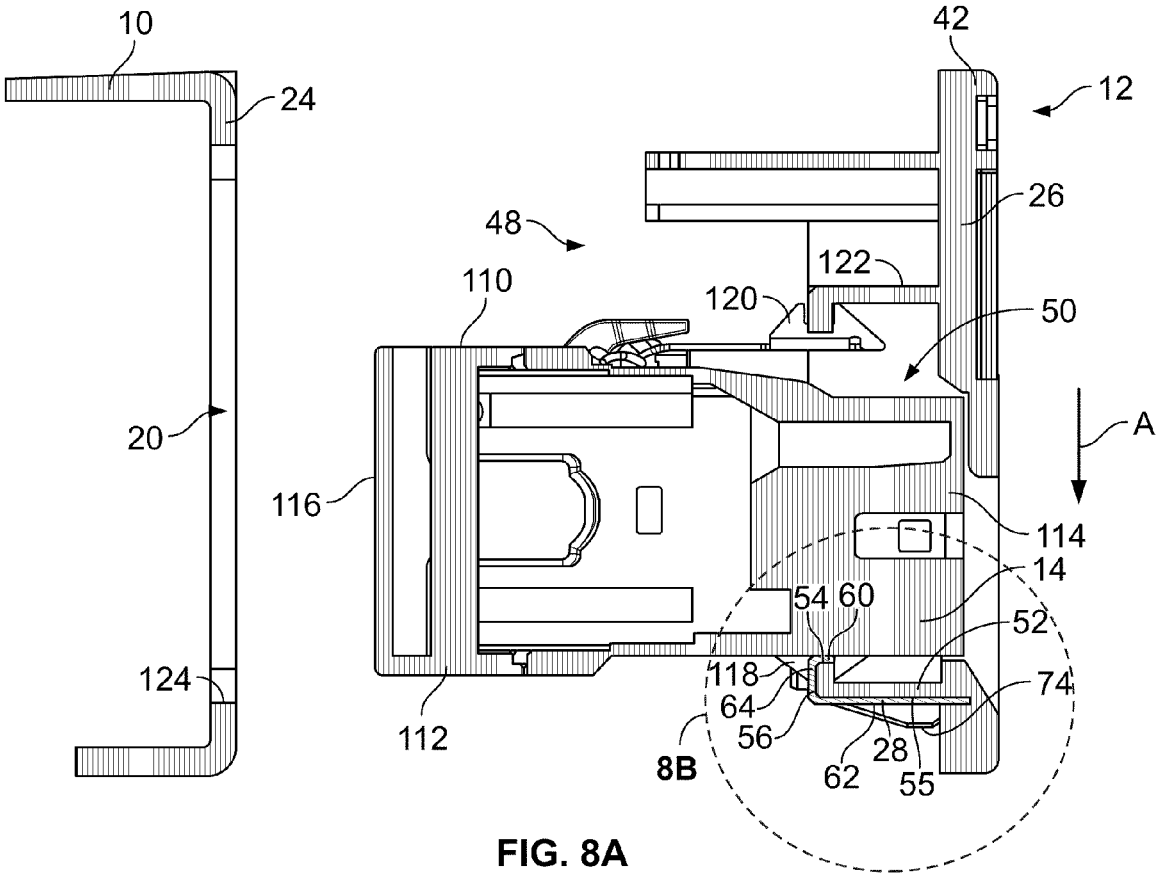
FIGS. 8A and 8B show a sectional view of the interface module of FIG. 1 with the shielded modular jacks loaded therein.
Figure 8B:
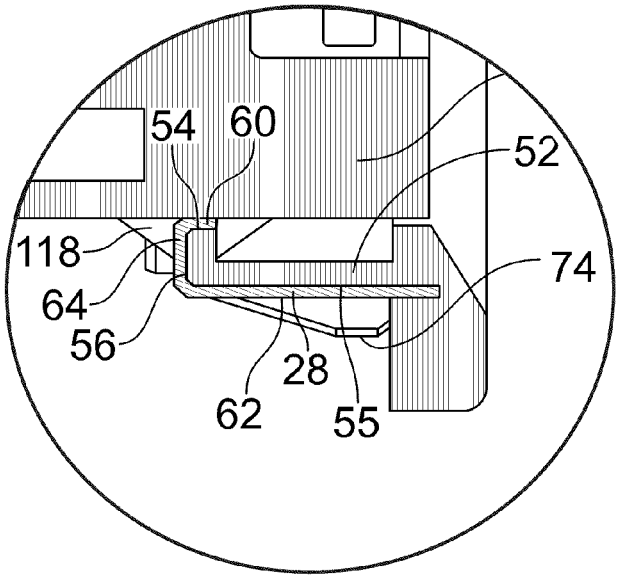

FIG. 7 shows a rear bottom cutaway view of the interface module 12 with the shielded modular jacks 14 loaded therein. FIGS. 8A and 8B show a sectional view of the interface module 12 with the shielded modular jacks 14 loaded therein. The shielded modular jacks 14 include a top 110, a bottom 112, a mating end 114, and a cable end 116. The shielded modular jack 14 mates with a mating plug (not shown) that is loaded through the mating end 114. A cable (not shown) extends from the cable end 116.

In an exemplary embodiment, the shielded modular jacks 14 are loaded into the jack cavities 50 until the mating end 114 abuts the faceplate 42. A fixed latch 118 is provided along the bottom 112 and a flexible latch 120 is provided along the top 110. The fixed and flexible latches 118, 120 are used to mount the shielded modular jacks 14 to the housing 26. For example, the flexible latch 120 is depressed and the shielded modular jack 14 is inserted into the jack opening 48 so that the fixed latch 118 engages the bottom wall 52. The flexible latch 120 is then aligned with a top wall 122 of the housing 26, and the flexible latch is released from a deflected or depressed position to engage the top wall 122. When the latches 118, 120 engage the walls 52, 122, the shielded modular jack 14 is securely coupled to the housing 26. In an exemplary embodiment, the flexible latch 120 biases the shielded modular jack 14 against the bottom wall 52, in the direction of arrow A shown in FIGS. 7 and 8, to ensure engagement of the fixed latch 118 with the bottom wall 52. In alternative embodiments, other fastening means as known in the art may be used to secure the shielded modular jacks 14 to the housing 26.

As illustrated in FIG. 8, when the shielded modular jack 14 is mounted to the bottom wall 52, the shielded modular jack 14 engages, and is electrically coupled to, the bond bar 28. In particular, the jack interface 60 of the bond bar 28 extends along the inner surface 54 of the bottom wall 52 and the shielded modular jack 14 abuttingly engages the jack interface 60, thus creating a bond path, and potentially a ground path, therebetween. In an exemplary embodiment, at least a portion of the fixed latch 118 abuttingly engages at least a portion of the end wall 64 of the bond bar 28, thus creating a bond path, and potentially a ground path, therebetween. In such embodiment, the shielded modular jack 14 engages two different surfaces of the bond bar 28. In alternative embodiments, the bond bar 28 may be provided on or coupled to alternative portions of the housing 26, such that the bond and/or ground between the shielded modular jack 14 and the housing 26 is created in alternative locations. For example, the bond bar 28 may be provided along the faceplate 42 or the top wall 122. In another alternative embodiment, the shielded modular jacks 14 may be securely coupled to the housing 26 in a different way, or the panel 10 may be configured differently, such that the shielded modular jacks 14 may directly engage the panel 10.

During assembly, once the shielded modular jacks 14 are coupled to the housing 26 and bonded to the bond bar 28, the interface module 12 is mated to the panel 10. The interface module 12 is loaded into the panel opening 20 from the front and latched into place with the latches 44, 46 (shown in FIGS. 1 and 2). The face plate 42 generally abuts the front surface 24. As the interface module 12 is mated with the panel 10, the bond bar 28 engages the panel 10, thus bonding to, and potentially being grounded to, the panel 10. In particular, the flexible beams 74 engage a mating surface 124 of the panel 10. The flexible beams 74 may be at least partially deflected by the panel 10 to maintain mechanical and electrical connection therebetween. Consequently, the interface module 12 provides a secure mounting for a plurality of shielded modular jacks 14 and a complete bond path circuit when the interface module 12 is mounted to a panel 10 or other equipment opening. In an alternative embodiment, electrical interconnection may be made between the bond bar 28 and the mating surface 124 without the use of the flexible beams 74. For example, the size of the panel opening 20 may guarantee electrical connection therebetween, or alternatively, another biasing element may be provided on the housing 26 or the panel 10 to bias the housing 26, and thus the bond bar 28, against the mating surface 124.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An interface module for holding a plurality of individual shielded modular jacks that are provided at ends of corresponding cables, the interface module comprising:

a housing having a plurality of jack openings configured to receive the individual shielded modular jacks therein such that the cables extend rearward from the housing, the housing having a mounting wall extending along one side of the jack openings, the mounting wall having an inner wall surface and an outer wall surface parallel to and opposite the inner wall surface, the inner wall surface facing the jack openings; and at least one bond bar coupled to the mounting wall, the at least one bond bar having a jack interface extending along and engaging the inner wall surface, the jack interface being configured to engage respective ones of the shielded modular jacks and the at least one bond bar having a panel interface extending along and engaging the outer wall surface, the panel interface being configured to engage a mating surface of a panel, the at least one bond bar configured to create an electrical connection between the respective ones of the shielded modular jacks and the mating surface of the panel.

2. The interface module of claim 1, wherein the at least one bond bar comprises a single bond bar configured to engage multiple ones of the shielded modular jacks.

3. The interface module of claim 1, wherein the jack interface is generally planar and is configured to extend along and engage only one side of the shielded modular jacks.

4. The interface module of claim 1, wherein the at least one bond bar includes a plurality of flexible beams provided on the panel interface, the flexible beams are configured to be loaded against the mating surface of the panel to maintain connection between the bond bar and the panel.

5. The interface module of claim 1, wherein the jack interface and the panel interface are spaced apart from one another and extend generally parallel to one another, the bond bar includes an end wall extending between the jack interface and the panel interface, the end wall being engaged by portions of the shielded modular jacks.

6. The interface module of claim 1, wherein the housing includes a front and a rear, the housing further includes a plurality of cavities that receive the shielded modular jacks therein and extend at least partially between the front and the rear, the plurality of jack openings provide access to respective ones of the cavities.

7. The interface module of claim 1, wherein the housing includes a plurality of cavities that receive the shielded modular jacks therein, wherein the plurality of jack openings provide access to respective ones of the cavities, and wherein the mounting wall defines one wall of the cavities.

8. The interface module of claim 1, wherein the housing includes a faceplate having a plurality of plug openings, the plug openings are configured to receive mating plugs therethrough, wherein the plug openings are aligned with the jack openings such that the mating plugs are mated with the shielded jack modules.

9. The interface module of claim 1, wherein the at least one bond bar is J-shaped defining a cupped section at an end of the at least one bond bar, the at least one bond bar being mounted to the mounting wall such that the cupped section wraps around the mounting wall and is provided on opposed sides of the mounting wall.

10. The interface module of claim 1, wherein the housing is configured to be loaded though an opening in a front wall of the panel, a perimeter of the opening defining the mating surface of the panel, the at least one bond bar being coupled to the mounting wall prior to the housing being loaded into the opening such that the panel interface engages the mating surface of the panel as the housing is loaded into the opening.

11. An interface module for holding a plurality of individual shielded modular jacks that are provided at ends of corresponding cables, the interface module comprising:

a housing having a plurality of jack openings configured to receive shielded modular jacks therein, the housing having a mounting wall extending along one side of the jack openings, wherein the housing includes posts extending from the mounting wall; and at least one bond bar coupled to the mounting wall, the bond bar includes openings corresponding to the posts and the bond bar covers at least a portion of the mounting wall when the openings are mounted to the posts, the at least one bond bar having a jack interface configured to engage respective ones of the shielded modular jacks and a panel interface configured to engage a mating surface of a panel, the at least one bond bar configured to create an electrical connection between the respective ones of the shielded modular jacks and the mating surface of the panel.

12. The interface module of claim 11, wherein the at least one bond bar comprises a single bond bar configured to engage multiple ones of the shielded modular jacks.

13. The interface module of claim 11, wherein the jack interface is generally planar and is configured to extend along and engage only one side of the shielded modular jacks.

14. The interface module of claim 11, wherein the at least one bond bar includes a plurality of flexible beams provided on the panel interface, the flexible beams are configured to be loaded against the mating surface of the panel to maintain connection between the bond bar and the panel.

15. The interface module of claim 11, wherein the at least one bond bar is J-shaped defining a cupped section at an end of the at least one bond bar, the at least one bond bar being mounted to the mounting wall such that the cupped section wraps around the mounting wall and is provided on opposed sides of the mounting wall.

16. The interface module of claim 11, wherein the housing is configured to be loaded through an opening in a front wall of the panel, a perimeter of the opening defining the mating surface of the panel, the at least one bond bar being coupled to the mounting wall prior to the housing being loaded into the opening such that the panel interface engages the mating surface of the panel as the housing is loaded into the opening.

17. An interface module comprising:

a plurality of shielded modular jacks having deflectable retention feature;

a housing having a plurality of jack openings that receive respective ones of the shielded modular jacks, the deflectable retention features of the shielded modular jacks engage the housing to secure the shielded modular jacks to the housing, wherein the housing is configured to be mounted to a panel such that the plurality of shielded modular jacks are simultaneously mounted to the panel;

at least one bond bar coupled to the housing, the at least one bond bar having a jack interface engaging respective ones of the shielded modular jacks and a panel interface configured to engage a mating surface of the panel, wherein the deflectable retention features bias the shielded modular jacks against the bond bar, the at least one bond bar configured to create an electrical connection between the respective ones of the shielded modular jacks and the mating surface when the housing is mounted to the panel.

18. The interface module of claim 17, wherein the bond bar includes a plurality of flexible beams provided on the panel interface, the flexible beams are configured to be loaded against the mating surface of the panel to maintain connection between the bond bar and the panel.

19. The interface module of claim 17, wherein the housing includes a faceplate having a plurality of plug openings, the plug openings are configured to receive mating plugs therethrough, wherein the plug openings are aligned with the jack openings such that the mating plugs are mated with the shielded jack modules.

20. The interface module of claim 17, wherein the jack interface and the panel interface are spaced apart from one another and extend generally parallel to one another, the bond bar includes an end wall extending between the jack interface and the panel interface.

* * * * *